US006837742B1

(12) United States Patent
Chou et al.

(10) Patent No.: US 6,837,742 B1
(45) Date of Patent: Jan. 4, 2005

(54) MODULAR CONNECTOR ASSEMBLY WITH LATCHING STRUCTURE

(75) Inventors: De-Zhao Chou, Hsi Chih (TW); Hai-Dong Wu, TungKuan (TW); Jian-Gang Zhou, TungKuan (TW)

(73) Assignee: Wieson Technologies Co., Ltd., Taipei Hsien (TW)

( * ) Notice: Subject to any disclaimer, the term of this patent is extended or adjusted under 35 U.S.C. 154(b) by 0 days.

(21) Appl. No.: 10/465,683

(22) Filed: Jun. 20, 2003

(51) Int. Cl.[7] ..... H01R 13/60
(52) U.S. Cl. ..... 439/541.5; 439/607
(58) Field of Search ..... 439/607–610, 439/541.5, 490, 540.1

(56) References Cited

U.S. PATENT DOCUMENTS 6,174,198 B1 * 1/2001 Wu et al. ..... 439/541.5
6,183,292 B1 * 2/2001 Chen et al. ..... 439/541.5
6,478,610 B1 * 11/2002 Zhou et al. ..... 439/490
6,478,616 B1 * 11/2002 Yeh ..... 439/541.5
6,508,665 B1 * 1/2003 Yeh ..... 439/541.5
6,655,988 B1 * 12/2003 Simmons et al. ..... 439/541.5
6,688,914 B1 * 2/2004 Espenshade et al. ..... 439/541.5
2003/0109174 A1 * 6/2003 Korsunsky et al. ..... 439/541.5

* cited by examiner

*Primary Examiner*—Michael C. Zarroli
(74) *Attorney, Agent, or Firm*—Rosenberg, Klein & Lee

(57) ABSTRACT

A modular connector assembly includes at least a lower body, an upper body fastenable to the lower body, a plurality of terminal sockets mountable in housing chambers formed on the upper body, a connection circuit board to receive and connect terminal legs and contact terminals located on the upper body and the lower body, and a shell to encase all of these elements.

8 Claims, 11 Drawing Sheets

MODULAR CONNECTOR ASSEMBLY WITH LATCHING STRUCTURE

BACKGROUND OF THE INVENTION

1. Field of the Invention

The present invention relates to a connector assembly and particularly to a connector that is modularized, visualized and may be customized.

2. Description of the Prior Art

Connectors are generally being referred to connecting elements and their accessories for linking electronic signals and power supply. In terms of electronic structure, the connector is an insert element that has an interconnection portion which may be coupled or separated, or replaceable. In other words, the connector is a bridge between signals. Its quality not only affects the reliability of electric current and signal transmission, also impacts the operation quality of the entire electronic device.

The connectors used in computers generally can be classified in I/O (Input/Output) type and Interconnection type. The I/O type connectors are mainly used for signal transmission between the computer processor and peripheral devices such as mouse, display device, keyboard, printer, drawing machine and network systems. They include round connectors, angular connectors, coaxial connectors, and the like. The interconnection type connectors mainly are used inside the processor and peripheral devices for linking signals among the electronic elements and system modules. They include IC sockets, edge connectors, flat cables, and the like. As slim and light has become a prevailing trend nowadays, many vendors have directly used pliable printed circuit boards to replace the connectors. For instance, many consumer electronic products use the pliable printed circuit boards to connect internal circuits and signals rather than use the connectors. However, there are still many areas where the pliable printed circuit boards cannot be used, such as connection between various system products (e.g. connecting the computer to a scanner or the like). In such circumstances the connectors still must be used.

A good connector should have many features, such as "small wearing", "easy installation", "replication ability", "economics", "user-friendliness", etc. The present invention aims at targeting these features to develop a connector assembly which consists of modularized elements to enable user to configure and assemble based on requirements, and has a novel terminal leg configuration design to save the space required to accommodate the terminal legs and effectively reduce the size to make configuration of the connector more flexible.

SUMMARY OF THE INVENTION

The primary object of the present invention is to resolve the aforesaid disadvantages. The invention employs a modular approach that allows the connector structure to become a free designated assembly. It also can be colored to enhance visual distinction to achieve the effects of "small wearing", "easy installation", "replication", "economics", and "user-friendliness".

Another object of the invention is to reduce material usage through the structural features to lower production cost and improve market competitiveness.

Yet another object of the invention is to reduce signal interference of neighboring terminal sockets through the modular arrangement of a plurality of terminal sockets.

The foregoing, as well as additional objects, features and advantages of the present invention will be more readily apparent from the following detailed description, which proceeds with reference to the accompanying drawings.

DETAILED DESCRIPTION OF THE PREFERRED EMBODIMENT

Figure 1B:
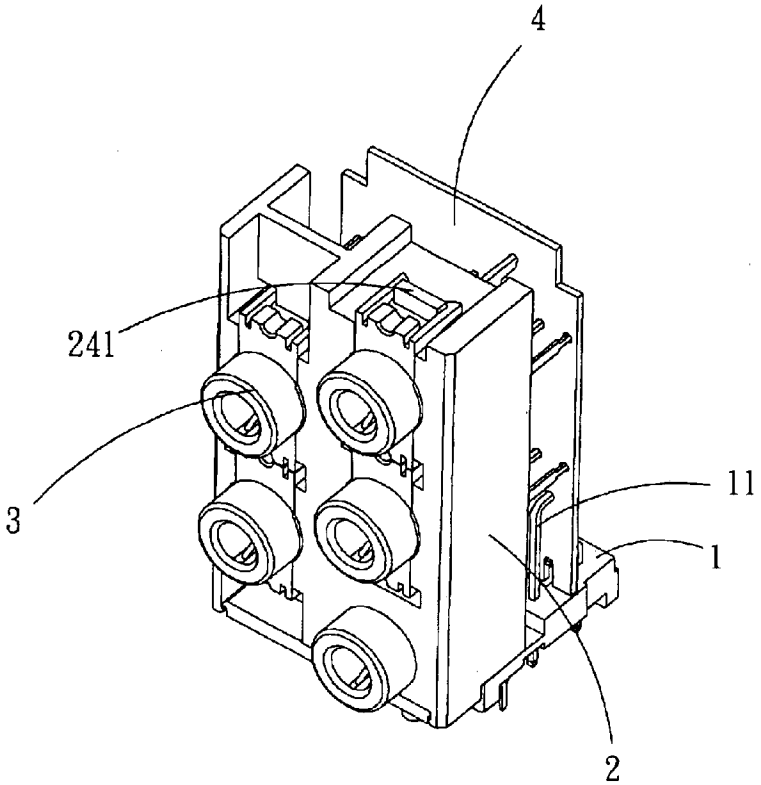
FIG. 1B is a perspective view of the present invention with the shell removed.
Figure 1A:
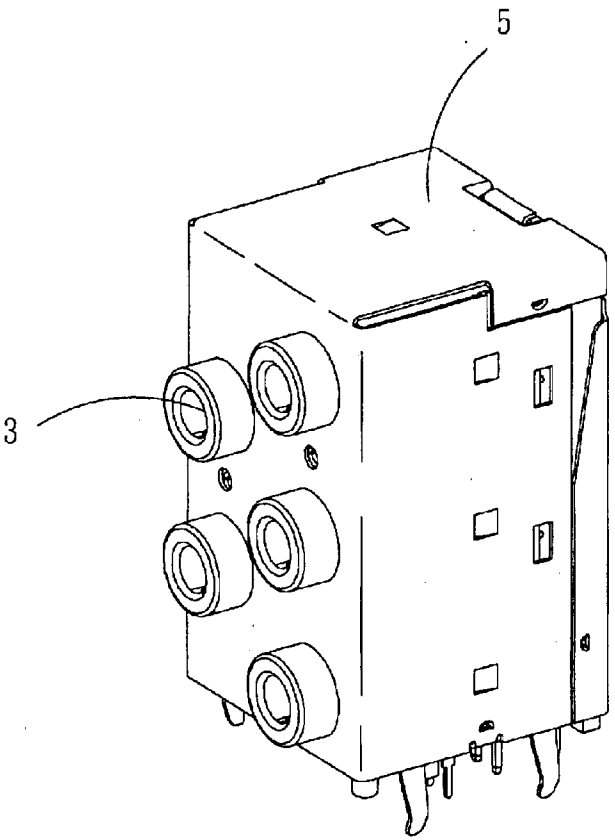
FIG. 1A is a perspective view of the present invention.
Figure 1C:
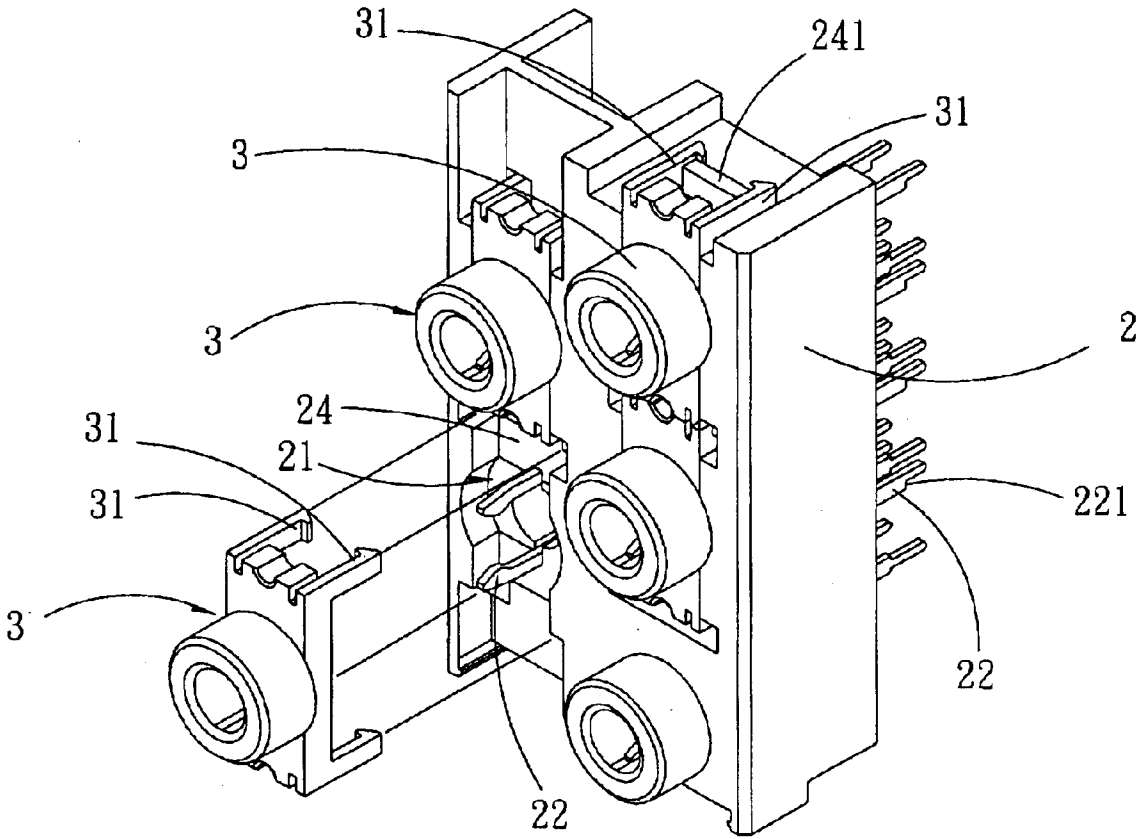
FIG. 1C is a perspective view of the present invention with one terminal socket detached.

Referring to FIGS. 1A, 1B and 1C, the connector assembly according to the present invention includes at least a lower body 1, an upper body 2, a plurality of terminal sockets 3 (five terminal sockets are shown in the drawings, but they are not the limit), a connection circuit board 4 and a shell 5

Figure 2:
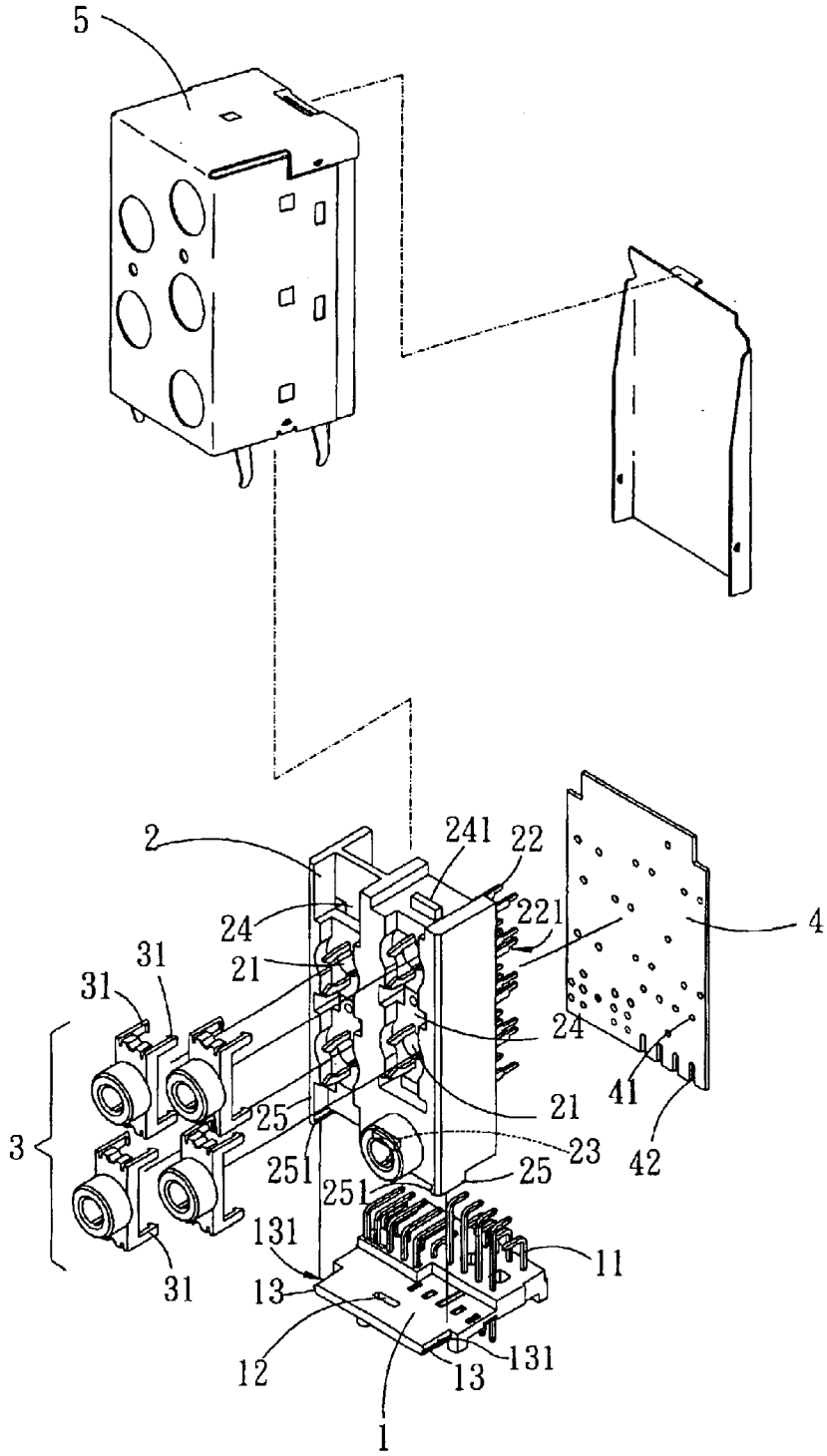
FIG. 2 is an exploded view of the present invention.
Figure 9:
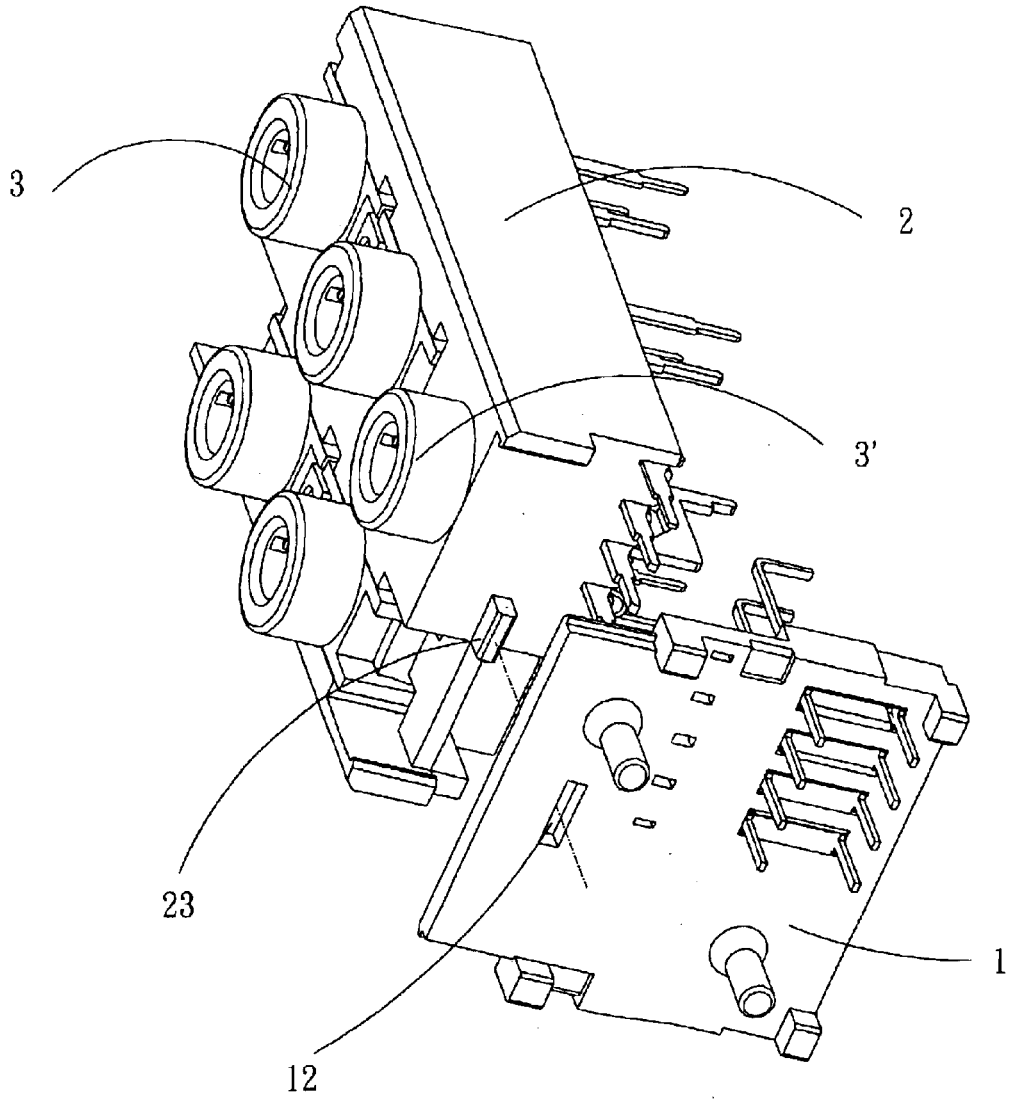
FIG. 9 is a bottom perspective view of the present invention.

Referring to FIG. 2, the lower body 1 has a plurality of contact terminals 11 which have one end insertable into a main circuit board (the technique for coupling the contact terminals 11 to the main circuit board is known in the art, thus is not shown in the drawings and detailed description also is omitted). The upper body 2 may be coupled with the lower body 1. The upper body 2 further has a plurality of housing chambers 21 which has terminal legs 22 located therein. In addition, the lower body 1 and the upper body 2 have a latch and an anchor means to enable the two to couple with each other in a vertical manner. The anchor means includes a stub 23 and a cavity 12 located respectively on the upper body 2 and the lower body 1 (also referring to FIG. 9). By aligning and coupling the stub 23 with the cavity 12, the upper body 2 and the lower body 1 may be positioned on a preset location to facilitate fastening. Moreover, the upper body 2 at substantially the rear side of the housing chamber 21 has an anchor section 24 which has one end extending outside the top section of the upper body 2 to form an extended end 241 to provide a clipping space.

The terminal sockets 3 may be disposed into the housing chambers 21 to couple with the terminal legs 22. Each terminal socket 3 has latch elastic arms 31 facing the housing chamber 21 to clip the anchor section 24 to achieve a secured anchoring so that the terminal sockets may be fastened to the upper body 2.

The connection printed circuit board 4 has preformed insert holes 41 corresponding to the terminal legs 22 and contact terminals 11 for coupling purpose. The connection printed circuit board 4 further has notches 42 to accommodate the contact terminals 111 of the lower body 1.

The shell 5 encases all the elements set forth above to form an integrated body.

Figure 5:
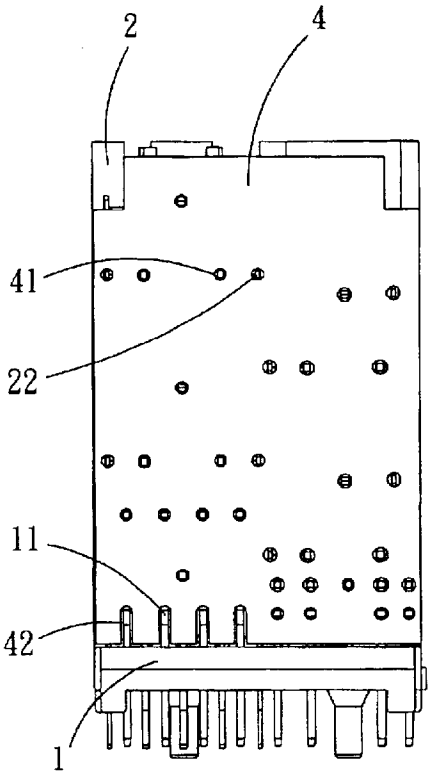
FIG. 5 is a rear view of the present invention (with the shell removed).
Figure 4:
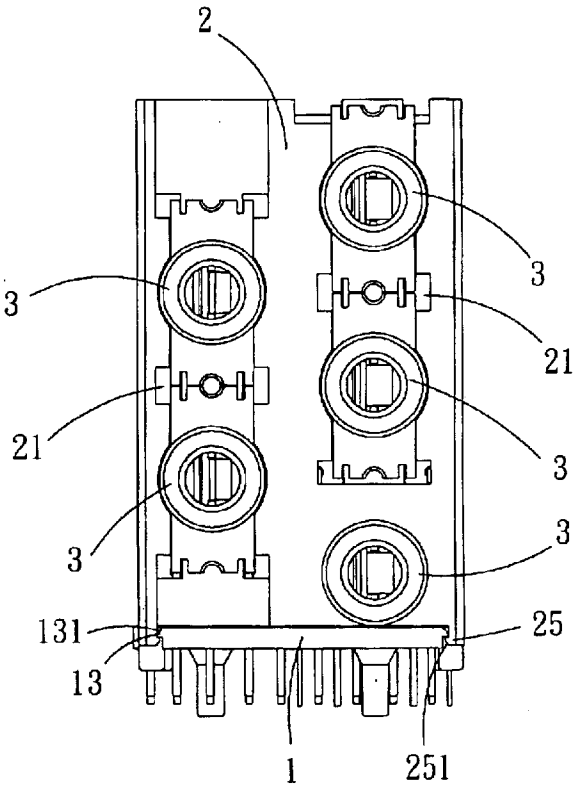
FIG. 4 is a front view of the present invention (with the shell removed).
Figure 3:
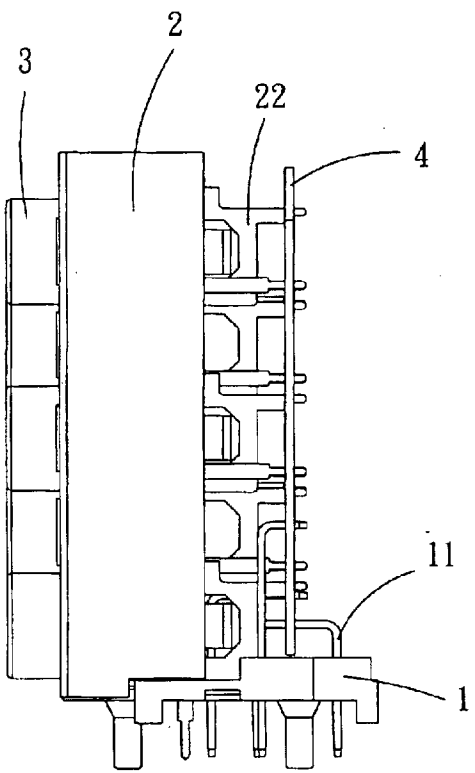
FIG. 3 is a side view of the present invention (with the shell removed).
Figure 6A:
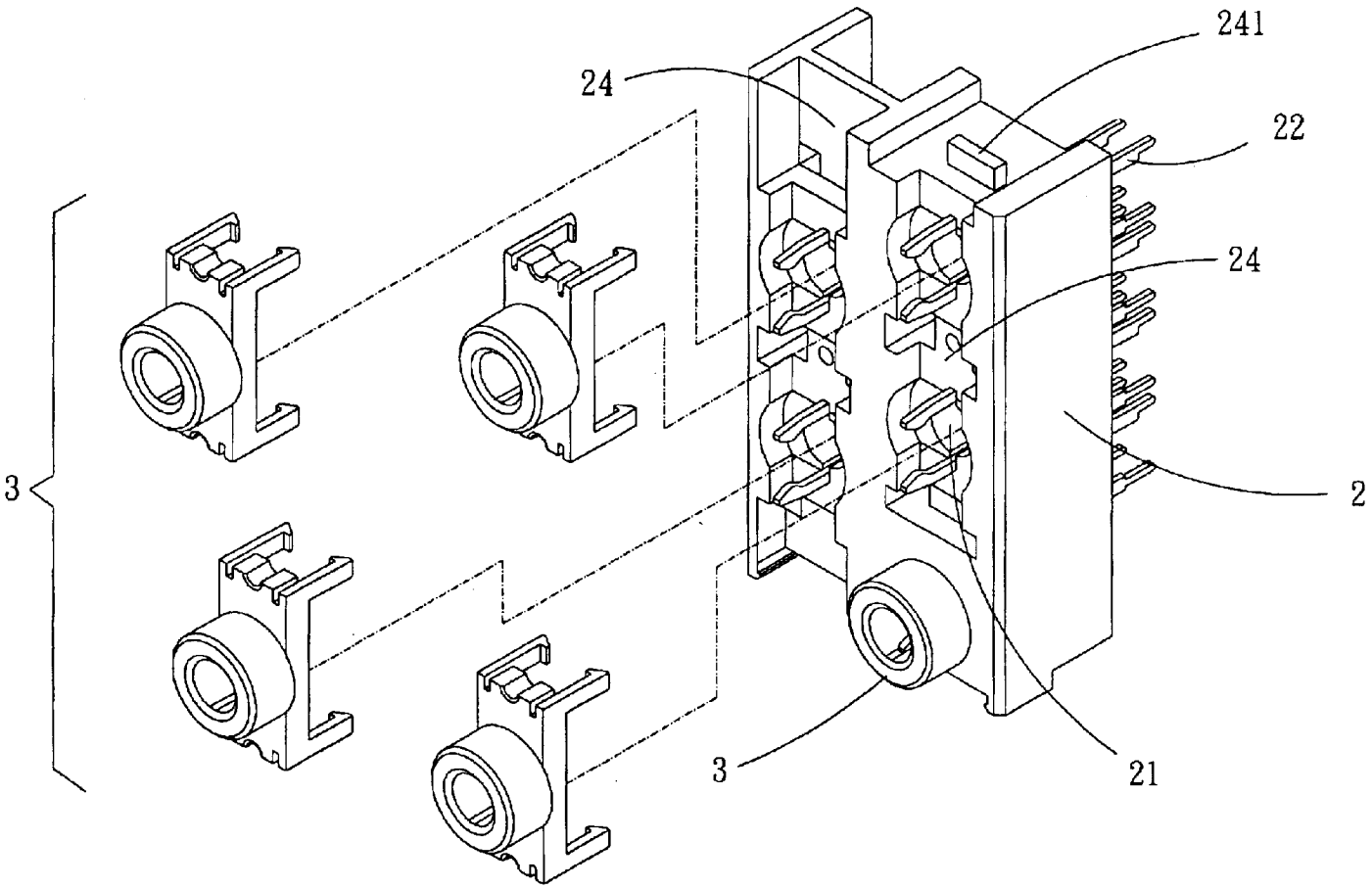
FIG. 6A is a schematic view of the present invention showing an assembly operation.
Figure 6B:
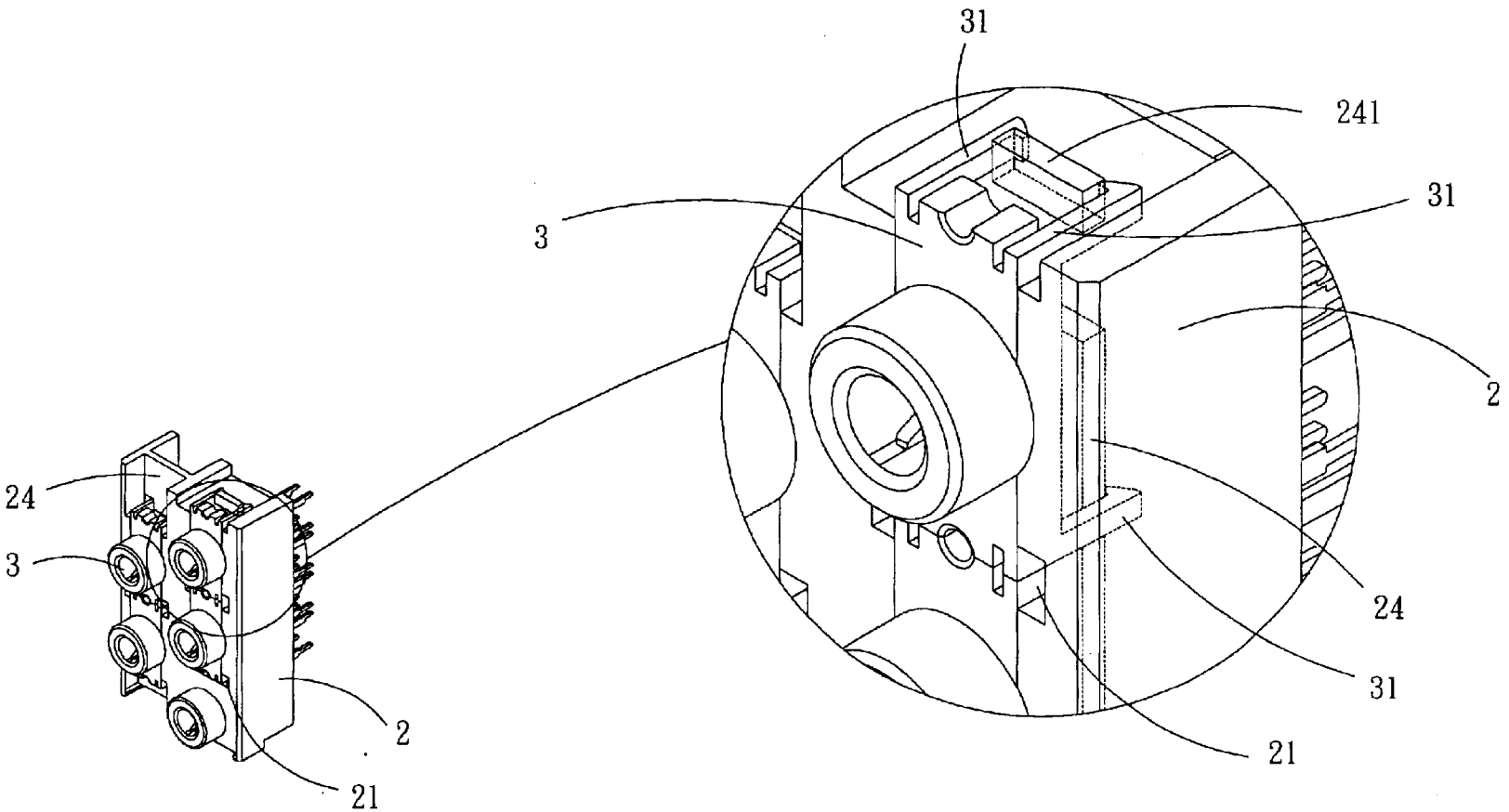
FIG. 6B is a fragmentary enlarged view of FIG. 6A.
Figure 7A:
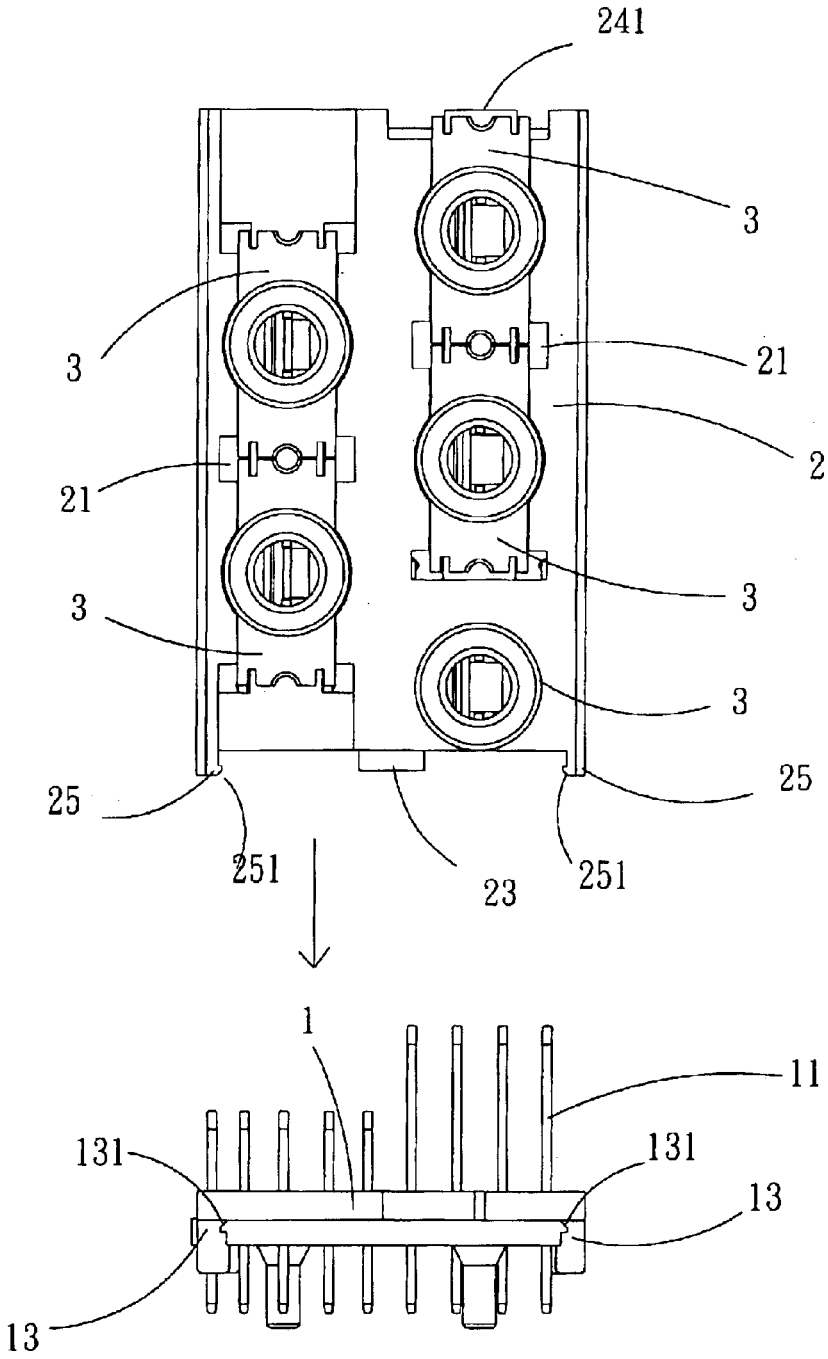
FIG. 7A is a schematic view of the present invention showing another assembly operation.
Figure 7B:
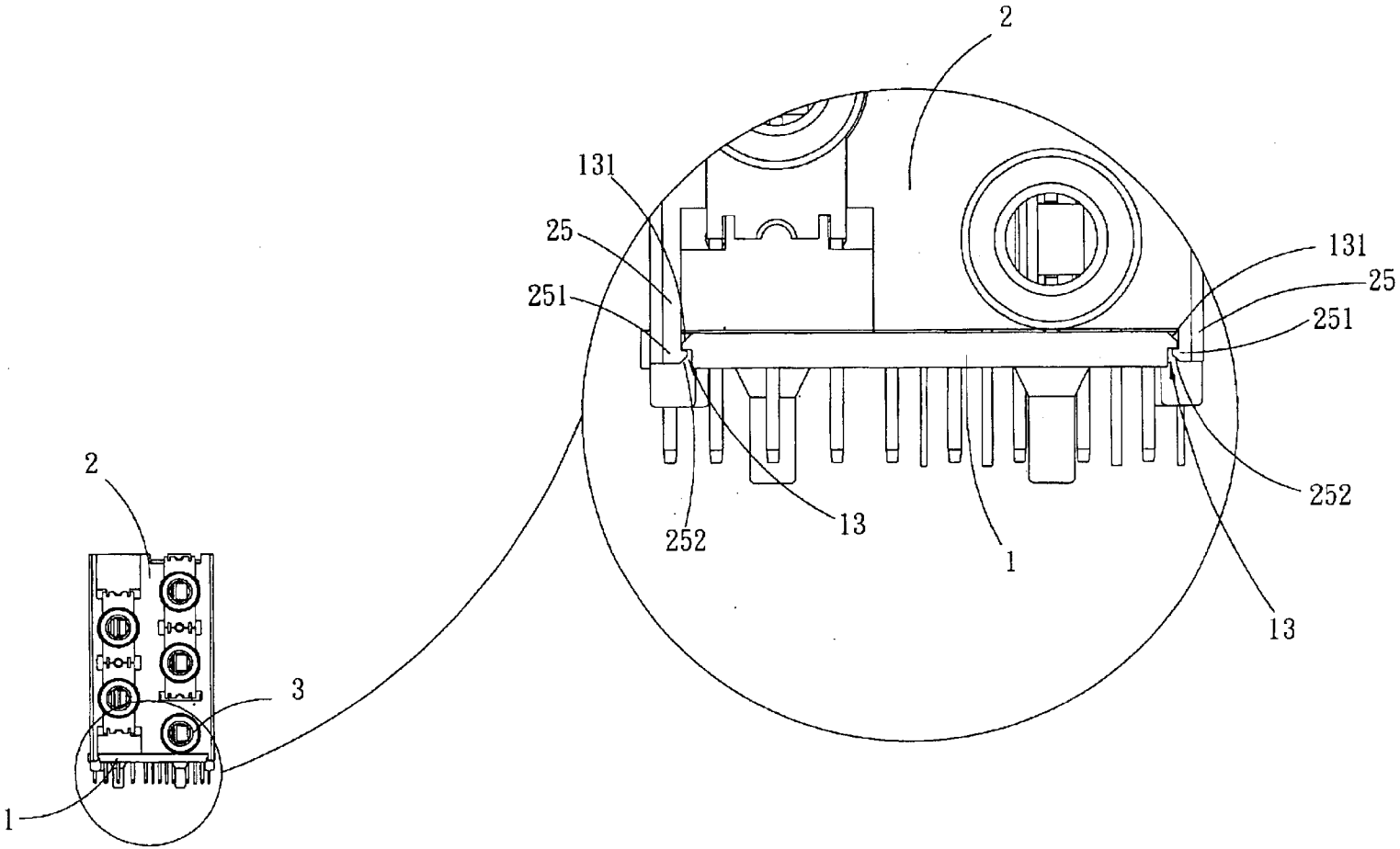
FIG. 7B is a fragmentary enlarged view of FIG. 7A.
Figure 8A:
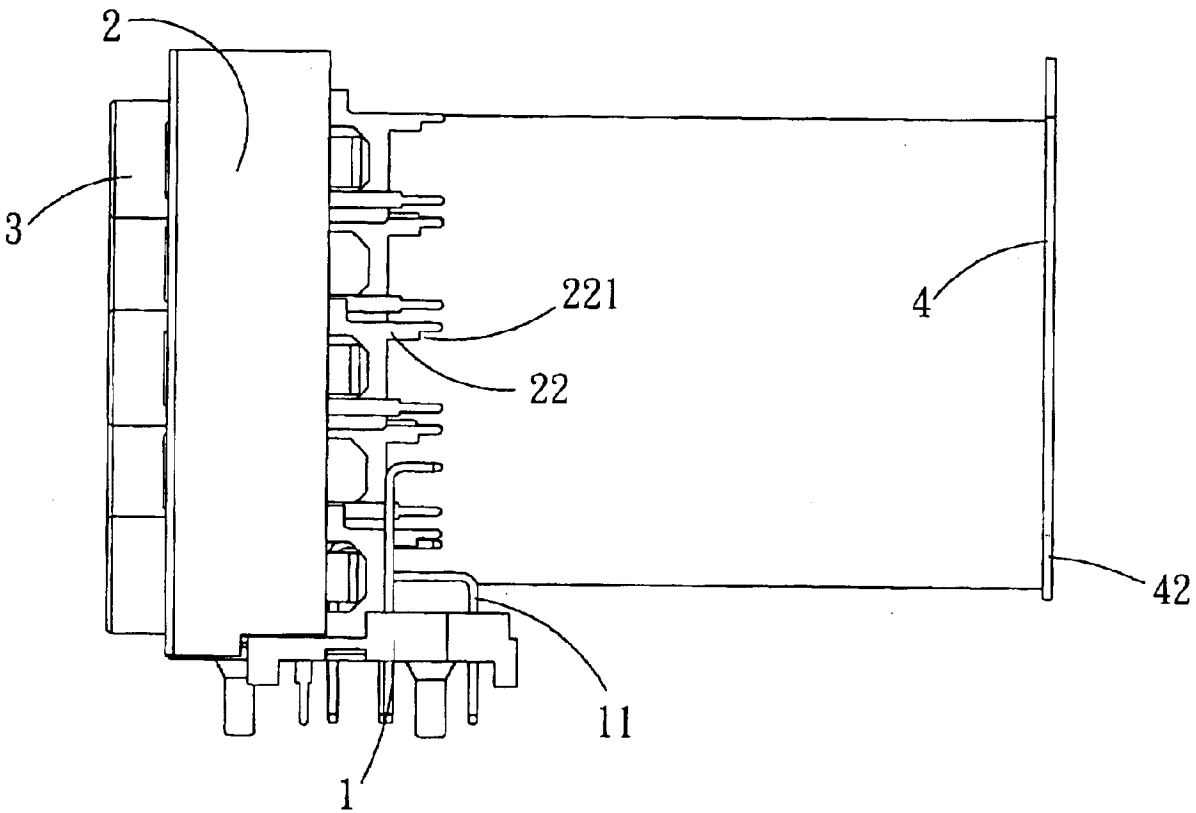
FIG. 8A is a schematic view of the present invention showing yet another assembly operation.
Figure 8B:
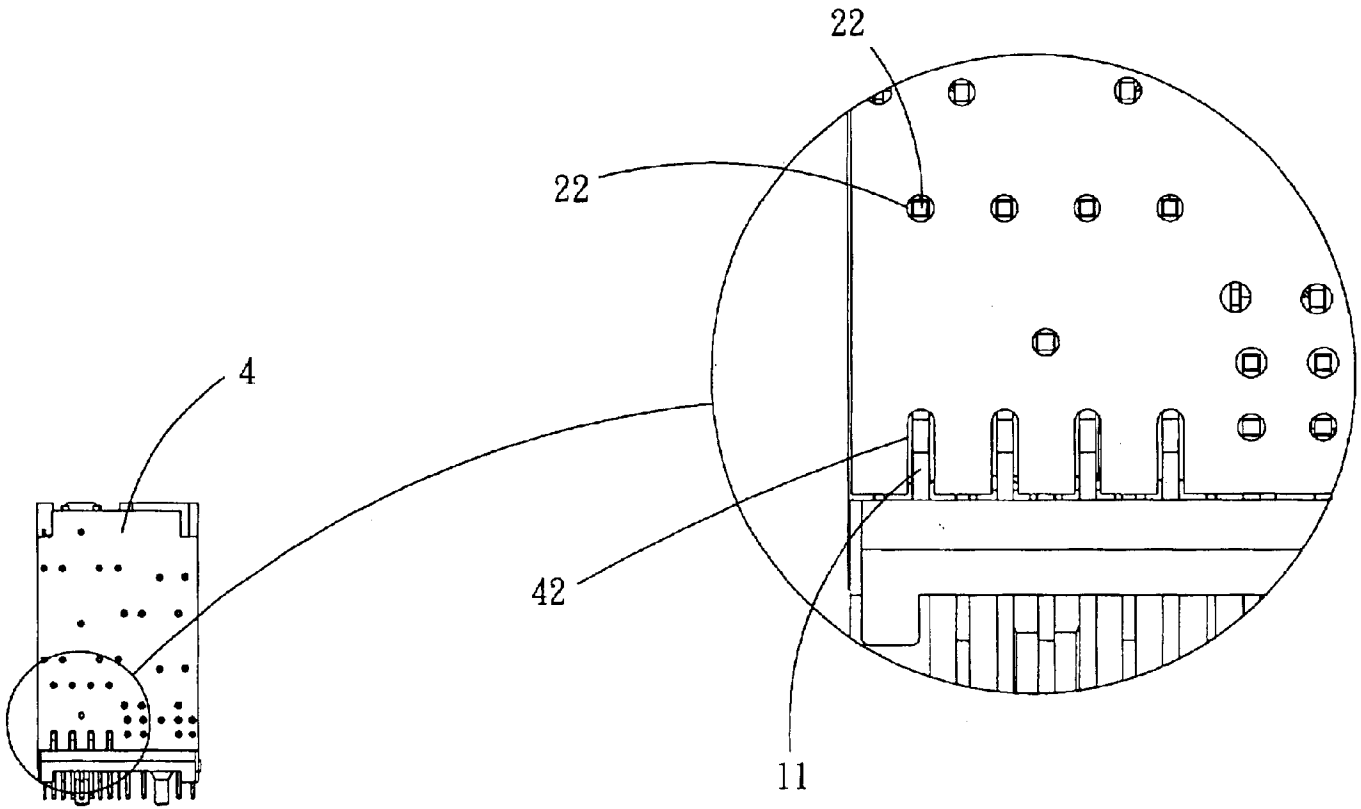
FIG. 8B is a fragmentary enlarged view of FIG. 8A.

Refer to FIGS. 3, 4 and 5 for the coupling and assembly relationship of various structural elements of the invention. Also refer to FIGS. 6A through 8B for detailed assembly operations. Among the five major elements of the invention, assembly of the upper body 2 and the terminal sockets 3 will be discussed first as follows. In one embodiment of the invention five terminal sockets 3 are used as an example. Among them, one terminal socket 3' is preformed on the upper body 2 and not removable. The rest four terminal sockets 3 are insertable into the housing chambers 21 and are latched on the anchor section 24 of the upper body 2. As shown in the drawings, the terminal socket 3 on the top end on the column where the not removable terminal socket 3' is located has its latch elastic arms 31 coupling on a jutting end 241. Such a coupling method allows the terminal socket 3 to be anchored in the housing chambers 21. Similarly, the latch elastic arms 31 of all other terminal sockets 3 may be coupled on the anchor section 24. Details are omitted.

For coupling of the upper body 2 and the lower body 1, the latch means is used. It includes clip arms 25 extending from two ends of the upper body 2. The front end of the clip arms 25 form respectively a hook 251 which has a sloped edge 252. The lower body 1 has a stepped recess 13 formed respectively on each of two sides at one end. The juncture of the upper end of the recess 13 and the lateral side of the lower body 1 forms a chamfered edge 131. The sloped edge 252 may slip over the chamfered edge 131 to allow the hook 251 of the clip arm 25 to wedge and latch in the recess 13 to couple the upper body 2 with the lower body 1. Moreover, the stub 23 and the cavity 12 on the upper body 2 and lower body 1 may serve as fool-proof positioning means. Once the stub 23 is aligned and inserted into the cavity 12, the upper body 2 and the lower body 1 may be coupled easily.

With the upper body 2 and the lower body 1 coupled, and the terminal sockets 3 positioned and anchored, the connection printed circuit board 4 and the shell 5 may be assembled. The connection printed circuit board 4 is inserted from the rear side. The insert holes 41 of the connection printed circuit board 4 correspond to the terminal legs 11 and contact terminals 11, and may be coupled with each other. The notches 42 formed on the connection printed circuit board 4 can accommodate the contact terminals 11 located on the lower body 1 to facilitate insertion of the printed circuit board 4 from the rear side. In addition, each terminal leg 22 has a tail end forming a stepped edge 221 to anchor on the connection printed circuit board 4 without overpass to form a secured coupling without shaking. Then the terminal legs 22 and contact terminals 11 inserted in the insert holes 41 are soldered to form a firm coupling to complete the assembly of the printed circuit board 4.

Finally encase the shell 5 on the upper body 2, terminal sockets 3 and the connection circuit board 4. The shell 5 has one end extended for a desired length to clip the lower body 1 to form a secured fastening. Then the assembly of the invention is completed. Comparing with conventional connectors, the connector assembly of invention is more versatile. For instance, the terminal sockets 3 may be made in different colors to enhance the visualized effect to enable users to easily distinguish their functions and purposes. Furthermore, the modular structure design enables users to adjust the number of the terminal sockets 3 based on requirements. As a result, user's procurement cost may be saved and vendor's production cost may be reduced.

While the preferred embodiment of the present invention has been set forth for the purpose of disclosure, modifications of the disclosed embodiment of the present invention as well as other embodiments thereof may occur to those skilled in the art. Accordingly, the appended claims are intended to cover all embodiments which do not depart from the spirit and scope of the present invention.

What is claimed is:

1. A connector assembly, comprising:

a lower body having at least one contact terminal which has one end insertable into a main circuit board, the lower body having a cavity formed therein;

an upper body fastenable to the lower body having at least one housing chamber which has terminal legs located therein, the upper body having a stub extending therefrom in aligned relationship with the cavity for insertion therein to position the upper body relative to the lower body;

latch means formed on the lower body and upper body for coupling the lower body and upper body together:

at least one terminal socket for anchoring in the housing chamber to couple with the terminal legs;

a connection printed circuit board having preformed insert holes corresponding to the terminal legs and the contact terminals for coupling with each other; and a shell for encasing aforesaid elements to form an integrated body.

2. The connector assembly of claim 1, wherein the latch means includes clip arms extending from two ends of the upper body, the clip arms having respectively a front end forming a hook.

3. The connector assembly of claim 2, wherein the hook has a front end forming a sloped edge.

4. The connector assembly of claim 1, wherein the latch means includes a stepped recess formed respectively on two sides of the lower body.

5. The connector assembly of claim 4, wherein the recess has an upper end forming respectively a chamfered edge on each of the two sides of the lower body.

6. The connector assembly of claim 1, wherein the upper body has an anchor section located substantially on a rear side of the housing chamber, the terminal socket having latch elastic arms to firmly clip the anchor section for securing the terminal socket thereto.

7. The connector assembly of claim 1, wherein the connection printed circuit board has notches formed thereon to accommodate the contact terminals located on the lower body.

8. The connector assembly of claim 1, wherein the terminal legs have a tail end forming a stepped edge to anchor on the connection printed circuit board.

* * * * *